US008979597B2

(12) United States Patent
Starke et al.

(10) Patent No.: US 8,979,597 B2
(45) Date of Patent: Mar. 17, 2015

(54) LEADFRAME HAVING SELECTIVELY REMOVABLE BRIDGES BETWEEN TERMINALS AND CONTACTS

(75) Inventors: Cord Starke, Blomberg (DE); Sebastian Schäfer, Blomberg (DE); Sebastian Scholz, Höxter (DE); John Huss, Harrisburg, PA (US)

(73) Assignee: Phoenix Contact GmbH & Co. KG (DE)

( * ) Notice: Subject to any disclaimer, the term of this patent is extended or adjusted under 35 U.S.C. 154(b) by 0 days.

(21) Appl. No.: 13/640,151

(22) PCT Filed: Apr. 14, 2011

(86) PCT No.: PCT/EP2011/055895

§ 371 (c)(1), (2), (4) Date: Nov. 29, 2012

(87) PCT Pub. No.: WO2011/128401

PCT Pub. Date: Oct. 20, 2011

(65) Prior Publication Data

US 2013/0065456 A1 Mar. 14, 2013

Related U.S. Application Data

(60) Provisional application No. 61/324,025, filed on Apr. 14, 2010, provisional application No. 61/324,477, filed on Apr. 15, 2010.

(30) Foreign Application Priority Data

Apr. 15, 2010 (DE) ..... 10 2010 015 225

(51) Int. Cl.

| | |
|---|---|
| ***H01R 13/502*** | (2006.01) |
| ***H01R 29/00*** | (2006.01) |
| ***H01R 43/24*** | (2006.01) |
| *H01R 13/504* | (2006.01) |

(52) U.S. Cl.

CPC ..... *H01R 29/00* (2013.01); *H01R 43/24* (2013.01); *H01R 13/504* (2013.01)

USPC ..... 439/701

(58) Field of Classification Search

USPC ..... 439/701, 607.06, 949, 694; 361/611; 385/76

See application file for complete search history.

(56) References Cited

U.S. PATENT DOCUMENTS 5,031,310 A 7/1991 Mclean et al.
5,069,626 A 12/1991 Patterson et al.

(Continued)

FOREIGN PATENT DOCUMENTS

DE 102 32 281 A1 2/2004
EP 09 24 811 A1 6/1999
WO WO 2007/038026 A1 4/2007

OTHER PUBLICATIONS

International Search Report for International Application PCT/EP2011/055895 mailed Mar. 8, 2011.

*Primary Examiner* — Vanessa Girardi

(74) *Attorney, Agent, or Firm* — Knobbe, Martens, Olson & Bear LLP

(57) ABSTRACT

The present invention relates to a leadframe having a plurality of connections for electrical conductors, a plurality of contacts and at least two outer current bars, and to a connecting socket having a leadframe as well as to a system for transmission of electrical power, in particular from a plurality of solar modules (photovoltaic modules), having a connecting socket such as this. In order to devise a leadframe which occupies as little space as possible, at least one connection (32*a-e*) is provided for an electrical conductor between the outer current bars (34*a, b*). This allows the leadframe to have a compact physical shape. The invention is based on the discovery that leadframes are used in the prior art to bridge the distances between predetermined contact separations, offering the possibility of producing, in one stamped part, strip conductors which have different geometries. Furthermore, a connecting socket having such a leadframe is described, and a system for transmission of electrical power using such a connecting socket.

20 Claims, 14 Drawing Sheets

(56) References Cited

U.S. PATENT DOCUMENTS 6,325,640 B1 * 12/2001 Kasai ..... 439/76.2
7,940,504 B2 * 5/2011 Spitaels et al. ..... 361/93.1
2009/0156030 A1 6/2009 Itou et al.
2011/0183531 A1 * 7/2011 Hornung et al. ..... 439/76.1

* cited by examiner

LEADFRAME HAVING SELECTIVELY REMOVABLE BRIDGES BETWEEN TERMINALS AND CONTACTS

BACKGROUND OF THE INVENTION

The present invention relates to a lead frame having a plurality of terminals for electrical leads, a plurality of contacts and at least two outer current bars, to a connecting socket having a lead frame, and to a system comprising a connecting socket of this type for transmitting electrical power, particularly from a plurality of solar modules.

Within the context of the present invention, solar modules are particularly photovoltaic modules, in other words, modules which use incident light to generate electrical power, which can then be supplied to consumers.

From DE 102 32 281 A1, the use of a lead frame having current bars arranged parallel in sections within a connection assembly for connecting a connector cable to the stator winding ends of an external rotor motor is known. An arrangement of the contacts in accordance with the positions of the stator winding ends is also disclosed.

The problem addressed by the present invention is therefore that of specifying a lead frame having the smallest possible space requirement.

BRIEF SUMMARY OF THE INVENTION

This is achieved with a lead frame of the type described in the introductory portion in that at least one terminal (32*a-e*) for an electrical lead is provided between the outer current bars (34*a, b*). In this manner, a compact configuration of the lead frame can be achieved. The invention is based upon the knowledge that lead frames are used in the prior art for bridging the gaps of predefined contact distances, thereby providing an option for producing conducting tracks of different geometries from a single stamped part.

To produce a particularly compact and simple lead frame, in a preferred embodiment of the invention the outer current bars have first sections that extend essentially parallel to one another. This can be implemented even more effectively when the longitudinal extension of at least one terminal for an electrical lead extends transversely to the longitudinal extension of the first section of the outer current bar.

To be able to produce a connection between the current bars and the terminals for electrical leads, bridges are provided between the first sections of the outer current bars and the terminals for electrical leads. Said bridges can be produced in a simple manner in the case of a stamped part.

In a preferred embodiment of the invention, a second section of each outer current bar is arranged at an angle in relation to the first section, and between at least one of the second sections and one of the terminals for an electrical lead, a bridge is provided. In this embodiment, the bridges are accessible even when leads are connected.

By arranging at least one current bar as an inner current bar between the two outer current bars, the configuration is kept compact even when additional current bars are used, and therefore keeps the space requirement low.

A further decrease in the space requirement can be achieved by aligning the contacts perpendicular to a plane that is spanned by the current bars and the terminals, as this results in a contacting of the contacts by a plug-type connector also perpendicular to the plane that is spanned by the current bars and terminals, and therefore perpendicular to the largest dimension of the lead frame.

The shape of the current bars is particularly preferably rectilinear, as this results in a simple structure of the lead frame and therefore also of the stamping tool.

In a particularly preferred embodiment, the lead frame has fewer contacts than terminals for electrical leads, so that even with a limited number of contacts, a higher-core cable can be uniformly installed and the individual leads of the cable can be reliably accommodated. This also makes a faulty connection, e.g., resulting from a confusion of the leads in wiring the lead frame, less probable than if the assignments of the individual leads to the terminals vary from lead frame to lead frame. The planned assignment of the leads to the contacts is achieved by the corresponding assignment of the bridges of the lead frame. Depending upon the wiring requirements, said assignments can vary according to a predefined pattern.

In a particularly preferred further development, adjoining end faces of the terminals for electrical leads are characterized by the presence of short residual sections of stamped-out lands. These are products of a particularly efficient production of the lead frame according to the invention, specifically by stamping, wherein the lands, which will no longer be required at a later time, are also punched out. In this case, however, the stamping tool will not punch the lands out with perfect precision at every location, and instead, small dimensional variations will have to be taken into consideration through tolerances. However, to avoid reducing the required material cross-section and as a result, reducing current carrying capacity, the tolerances are preferably taken into account in the opposite direction, so that residual sections of the punched-out lands cannot be avoided.

In order to maintain the necessary minimum distances while still achieving a production-friendly but nevertheless compact configuration, the distances among the terminals for electrical leads and the current bars, but also the distances between terminals for electrical leads and current bars measure ca. 1.8 mm to 4 mm and particularly preferably 1.8 mm to 3 mm.

The contacts are preferably spaced 4 mm to 12 mm and particularly preferably 9 mm to 10.5 mm from one another.

The lead frame, which produces the connection between cables connected thereto, is held within a connecting socket in order to protect it against contact, but also to protect it against undesirable factors.

In a preferred further development of the lead frame, the surfaces of the terminals that are provided for the leads to be connected jut out beyond the surfaces of the current bars.

This measure makes handling during connection of the terminals to the leads to be connected particularly simple, because the insulation exerts no force on the connection site, and because, even during connection, the connection site is kept free of foreign materials that could escape from the insulating material during connection.

To ensure a torsion-free connector assembly, in a preferred further development the plug connector face of the connecting socket is equipped with a mechanical code in the form of different geometries of the contact openings, so that a connector plug having a complementary connector face can be connected only in the predefined position.

To allow current to be supplied to a cable in a simple manner from a plurality of current sources, such as solar modules, for example, the cable mentioned in the introductory portion is characterized by a plurality of connecting sockets according to the invention, connected to the cable at predefined distances from one another.

The distribution of the load on the individual phases is particularly preferably implemented by means of bridges arranged in an alternating pattern in the connecting sockets.

In a particularly preferred further development of the invention, the cable is characterized by potted connecting sockets. In this manner, the connecting sockets are completely protected against penetrating particles and water (protection rating IP67).

A particularly simple and flexible production process is implemented by using a lead frame to produce a galvanic connection between terminals for electrical leads and contacts for a connector plug when connecting sockets are used for supplying electrical power to a cable.

A simple method for producing a cable comprises process steps, in which

- the cable is stripped and the insulation removed at predefined points,
- the stripped leads are connected to the terminals of the lead frame,
- cable and lead frame are placed in a connecting socket and the connecting socket is sealed,
- the connecting socket is potted.

In this process, the predefined respective assignment between terminals and current bars is implemented in that the connections between the terminals and the current bars are produced by first detaching predetermined bridges between the terminals and the current bars of the lead frame before the stripped leads are connected to the terminals.

Because the connections between the terminals and the current bars are produced by detaching predetermined bridges between the terminals and the current bars of the lead frame before the connecting socket is potted, the detachment step can be provided, adapted to the production process, at a time when it can be particularly advantageously integrated into the production process.

To make a connector plug having an interior space and a contacting area and having a housing formed from half shells safer, the interior space is filled with a casting compound which bonds with the cable and the housing. In this case, even in the event of damage to the connector plug, the fragments are held by the casting compound, so that access to leads that conduct potential is still prevented.

With a housing made of an impact resistant and UV resistant material, the connector plug becomes particularly tough, and therefore continues to provide effective protection for the components contained therein, even under intense UV irradiation.

To achieve good pottability, the connector contacts in the connector plug are sealed off from the interior space by a sealing plate, so that the casting compound cannot reach the connector contacts themselves and impair contact reliability.

Particularly preferably, the connector plug has sealing elements integrally formed on the half shells of the housing, which encompass the leads that extend out of the interior space to the connector contacts. This makes the use of a separate seal unnecessary, thereby simplifying the assembly of the connector plug.

Because the connector plug is embodied particularly for connecting a current source, particularly a solar module, to a collecting main with the interconnection of a connecting socket, the interaction of connector plug and connecting socket results in a particularly space-saving and reliable connection.

Particularly advantageous is a system for the transmission of electrical power, particularly from a plurality of solar modules, which comprises connecting sockets and connector plugs according to the invention and at least one cable according to the invention.

In what follows, the invention will be described in greater detail in reference to the figures. These show:

DETAILED DESCRIPTION

Figure 1:
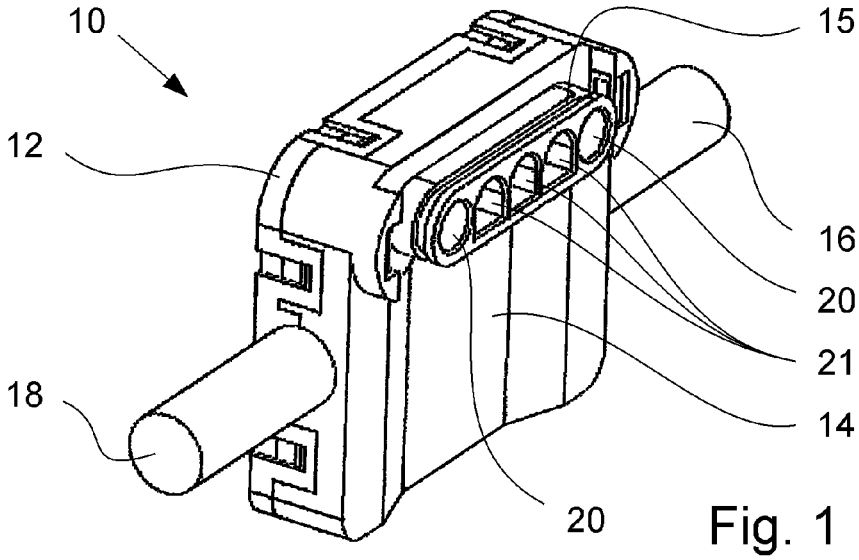
FIG. 1 a perspective illustration of a connecting socket according to the invention with a cable.

FIG. 1 shows a connecting socket 10 according to the invention with cables 16, 18. These cables 16, 18 can form a continuous strand, which is conducted through the connecting socket 10. However, they can also each be cable ends of cable segments of a predefined length, which are joined by the connecting socket 10 to form a strand. The length of this strand is not relevant to the invention, and longer cable lengths can be coiled in the customary fashion.

The housing 10 is formed from a bottom shell 12 and a top shell 14, which are latched to one another. The top shell 14 has a connection for a connector plug (not shown in this diagram) and the connector plug face, in other words, the region of the connecting socket 10 where the connector plug will be connected, has round openings 20 and at least partially angular openings 21. All the illustrated openings 20, 21 are intended for contacting and their number matches the number of contacts to be contacted. The figure shows only a housing with five openings. Naturally, if four contacts are used, a housing with four contacts will also be used.

The different shapes of the openings in the connector plug face serve as a mechanical code for the plug. Although round openings are universal, connector plugs that are incorrectly placed around the at least partially angular openings will not produce contact. Thereby, a correct fitting with the associated desired contact assignment is always ensured. Also shown in the figure is a sealing seat 15, which permits the accommodation of a seal known in the prior art, e.g., an O-ring, for sealing the transition between connecting socket 10 and connector plug 40 (not shown in this figure), so that the plug-type connector assembly as a unit satisfies the requirements of the relevant safety class. When the connecting socket 10 is not fitted with a connector plug, a sealing cap (not shown in the figure) can be placed on it and the openings thereby also sealed.

Figure 2:
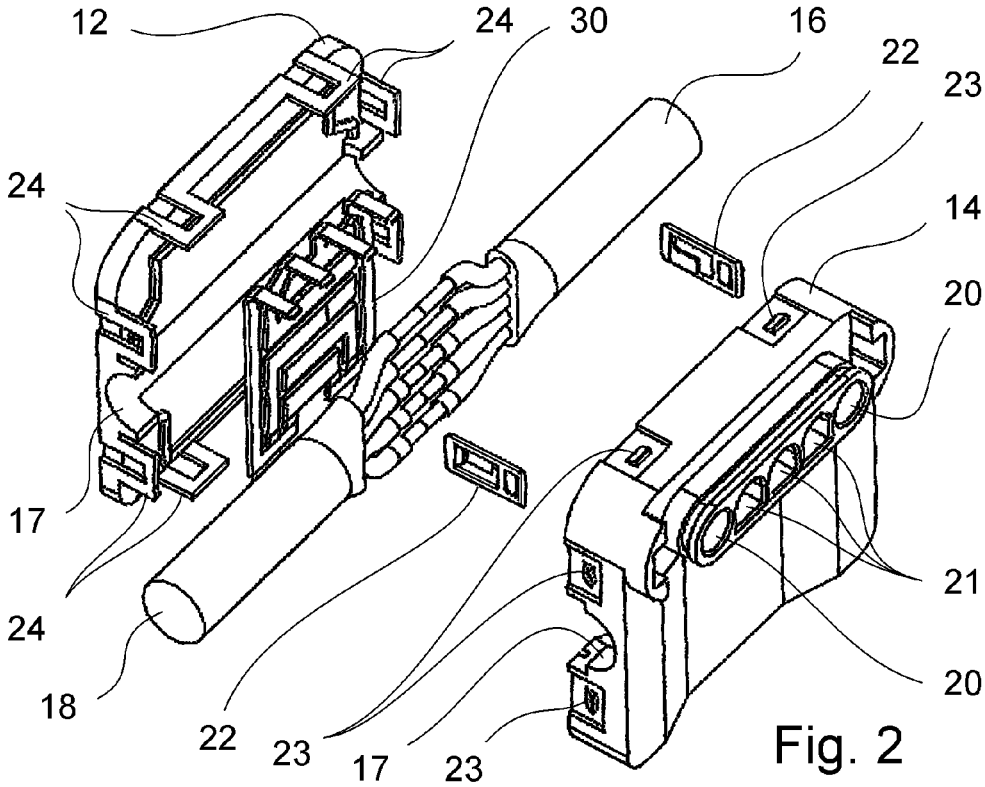
FIG. 2 an exploded illustration of the connecting socket of FIG. 1.

FIG. 2 shows the connecting socket 10 opened up. On the bottom shell 12, latching tabs 24 are clearly visible, which interact with latching catches 23 on the top shell 14, forming the housing of the connecting socket 10. Additionally, detent springs 22 are provided, which hold bottom shell 12 and top shell 14 securely together.

Inside the housing, cables 16, 18 are shown, which have been prepared for the electrical connection. Additionally, a so-called lead frame 30 is shown, which is provided for contacting and which will be described in greater detail below. The preparation of the cable 16, 18 comprises stripping the outer cable sheathing and removing the insulation around the individual leads so that they can be connected to one another. Preparation can also involve fanning out the leads, so that each of the leads is at a predefined distance from its adjacent lead and lies at a predefined position above the lead frame 30.

The cable openings 17 are embodied such that the housing of the connecting socket 10 can also function to provide cable relief. For this reason, the cable openings 17 are shaped such that the cable sheathing held in the interior of the housing of the connecting socket 10 is deformed such that its cross-section deviates from that of the cable openings 17 enough that it will not fit through them. Thereby, tensile stresses acting on the cables 16, 18 are carried into the housing of the connecting socket 10 and the cables 16, 18 are relieved.

The possible embodiments of the lead frame 30 are illustrated by way of example in FIGS. 3, 4, 5 and 11. Common to all lead frames 30 illustrated in these figures is that they are equipped with terminals 32*a-e*, which are provided for the leads to be connected (not shown in this figure). The leads can be connected to the lead frame 30 in a known manner. Techniques for connection, such as soldering, crimping, bonding, insulation displacement contacting (IDC), and welding (e.g., resistance welding), are well known to a person skilled in the art, and therefore, further discussion of these individual methods is not necessary here. Instead, a person skilled in the art will select and use the method that is suitable for each respective application.

The lead frame 30 further comprises current bars 34*a-d* and contacts 36*a-d*. The current bars 34*a-d* also form the connections between the terminals 32*a-e* and the contacts 36*a-d*. The contacts 36*a-d* form the connection to the outside, in other words, the connection to a cable with the interconnection of a connector plug.

As is clear from the figure, five terminals 32*a-e* but only four contacts 36*a-d* are provided in each case. To be able to produce the desired configuration between terminals 32*a-e* and contacts 36*a-d*, bridges 38*a-f* are provided, which are disconnected based upon the respective configuration to be produced. This disconnection can be implemented, e.g., by punching out or simply detaching those bridges 38*a-d* that are not required. The terminals 32*a-e* and the contacts 36*a-d* are then assigned according to the remaining bridges, with the interconnection of the current bars 34*a-d*. As is also clear from the figures, in the illustrated embodiments the two terminals 32*d*, 32*e* that are closest to the contacts 36*a-d* are connected without a bridge to the current bars, and from there to the contacts 36*b*, 36*c*.

Between the terminals 32*a-e*, lands 39 are provided. However, these lands 39 are relevant only to the production and handling of the lead frame 30 because they produce the necessary rigidity, and they are removed during assembly of the lead frame 30, e.g., by punching out.

Figure 3:
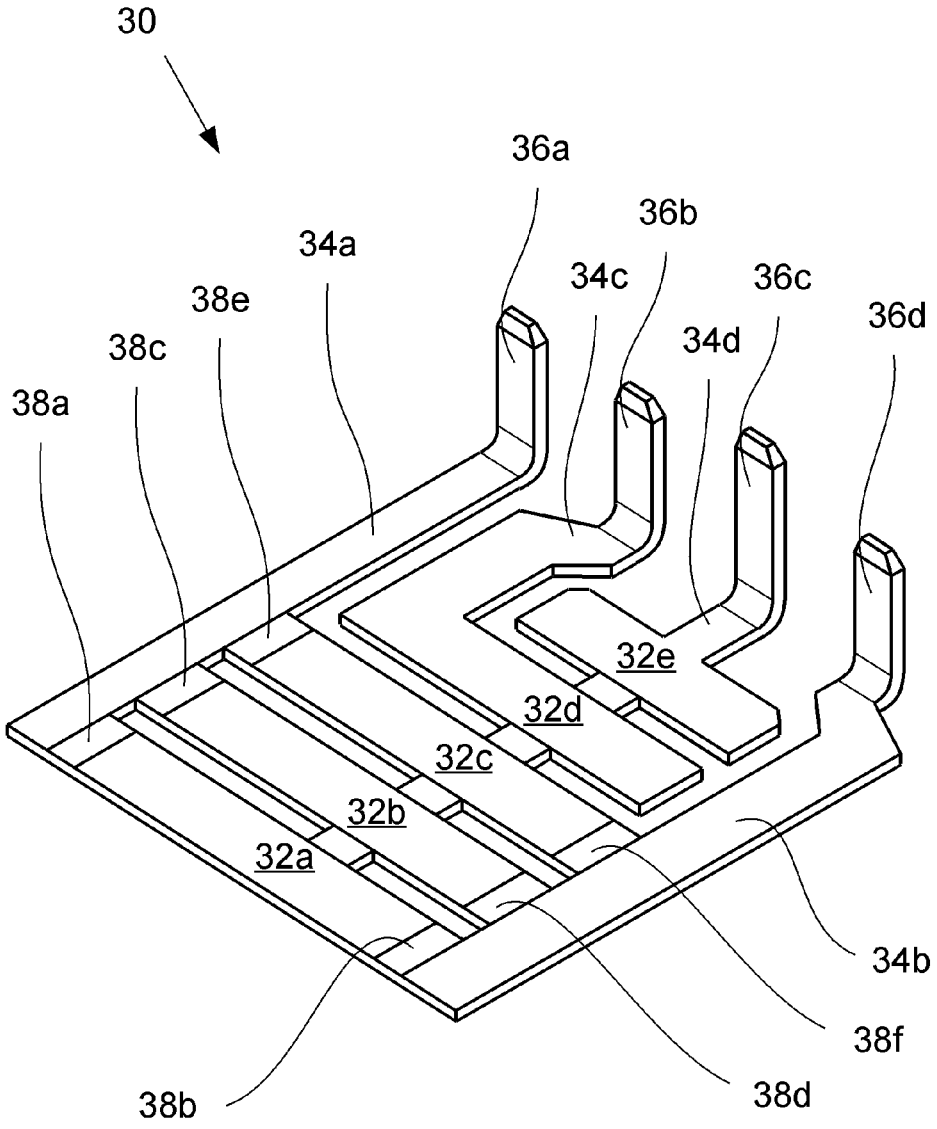
FIG. 3 a first embodiment of a lead frame according to the invention.

FIG. 3 shows an embodiment of the lead frame 30 having bridges 38*a-f*, with every two of said bridges connecting each of the three terminals 32*a*, 32*b*, 32*c* that are spaced the farthest from the contacts 36*a-d* to the outer current bars 34*a*, 34*c*. To detach one of the terminals 32*a*, 32*b*, 32*c* from the current bars 34*a*, 34*c*, the corresponding bridge 38*a-f* must be disconnected or detached. By disconnecting one of the bridges 38*a-f* that is assigned in each case to one of the terminals 32*a*, 32*b*, 32*c*, the terminal is assigned to one of the current bars 34*a*, 34*c*, and therefore, the connection between the terminal 32*a*, 32*b*, 32*c* and one of the contacts 36*a*, 36*d* is produced.

As is clear from FIG. 2, the leads are arranged on the lead frame 30, or conversely, the lead frame 30 is arranged beneath the leads. Arranging the bridges 38*a-f* beneath the leads as shown in FIG. 3 results in a maximum savings of space. In this case, however, it is advantageous to disconnect the bridges 38*a-f* according to the required assignment of the terminals 32*a*, 32*b*, 32*c* to the contacts 36*a*, 36*d*, before the leads are connected to the terminals 32*a*, 32*b*, 32*c* in the production process.

Figure 4:
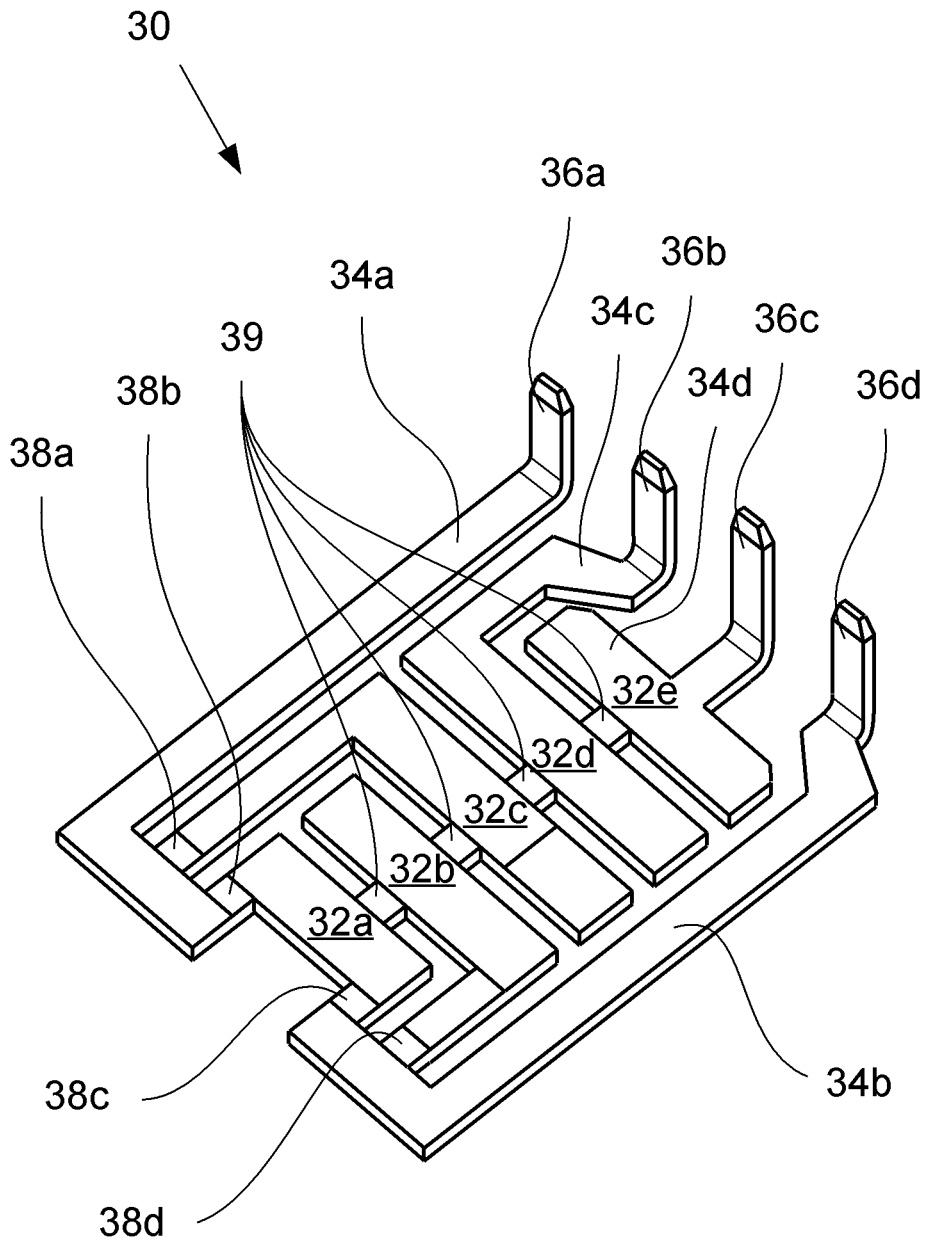
FIG. 4 a second embodiment of a lead frame according to the invention.

In FIG. 4, the positioning of the bridges 38*a-d* is different. In this figure as well, terminals 32*a-e* for the leads are provided, which, after being connected to the leads, lie beneath these leads. However, the bridges 38*a-d* have been moved to the side out of the area beneath the leads, so that the leads do not cover the bridges 38*a-d*. Therefore, the bridges 38*a-d* can be disconnected even after the leads have been connected. This allows the production process to be more flexible in design, since in this embodiment, the time of disconnection of the bridges 38*a-d* can be matched substantially more closely to the other requirements of the production sequence.

Figure 5:
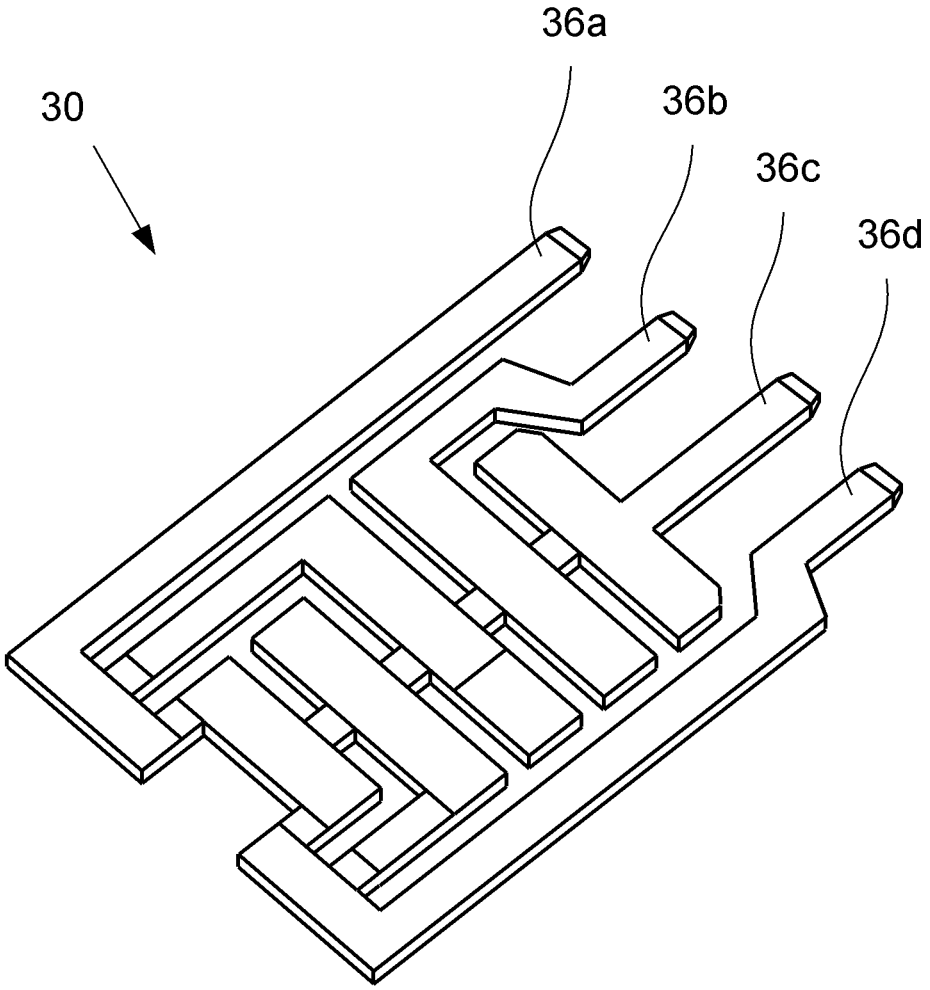
FIG. 5 a third embodiment of a lead frame according to the invention.

FIG. 5 differs from FIG. 4 in terms of the alignment of the contacts 36*a-d*. The contacts in FIG. 3 and FIG. 4 are aligned perpendicular to the plane of the current bars 34*a-d*, so that contacting is also carried out perpendicular to the plane of the current bars 34*a-d* (or to the plane spanned by the current bars 34*a-d* and the terminals 32*a-e*). In contrast to this, in FIG. 5 the contacts 36*a-d* extend within the plane spanned by the current bars 34*a-d* and the terminals 32*a-e*. Therefore, contacting can also be implemented within this plane, so that the most advantageous contacting can be established, based upon the space conditions, by selecting the proper lead frame 30 (and a suitable housing).

Figure 6:
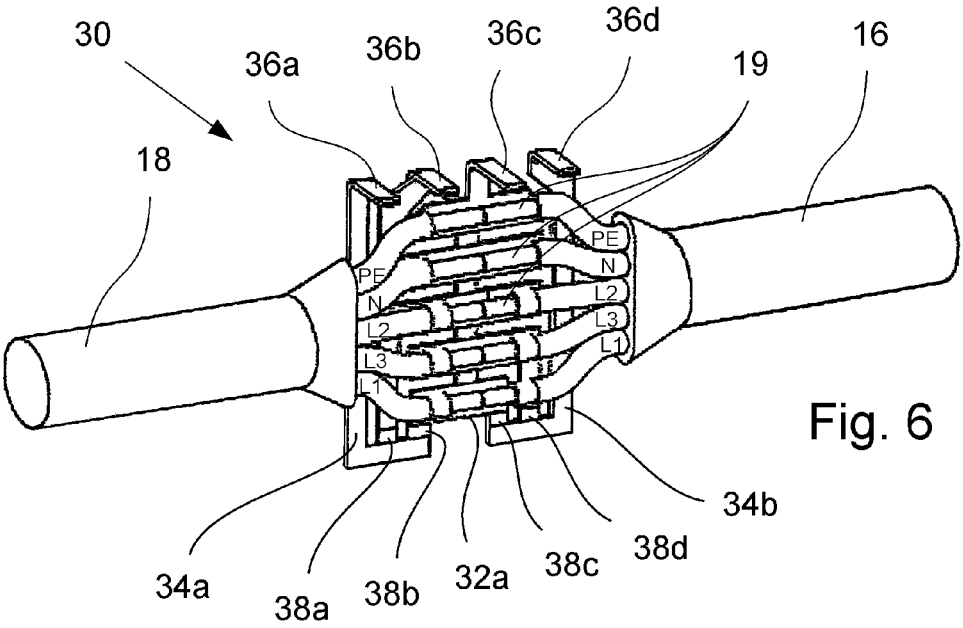
FIG. 6 a perspective illustration of the lead frame connected to the cable.

FIG. 6 shows a perspective illustration of leads L1, L2, L3, N, PE connected to the lead frame 30. In this figure as well, the covering of the terminals 32*a-e* by the leads L1, L2, L3, N, PE is very clear. In the figure, the bridges 38*a-d* are visible below the leads L1, L2, L3, N, PE, and therefore are not covered by the leads L1, L2, L3, N, PE, thus they can be disconnected (in other words, punched out, for example) at a suitable point during the production process.

Figure 7:
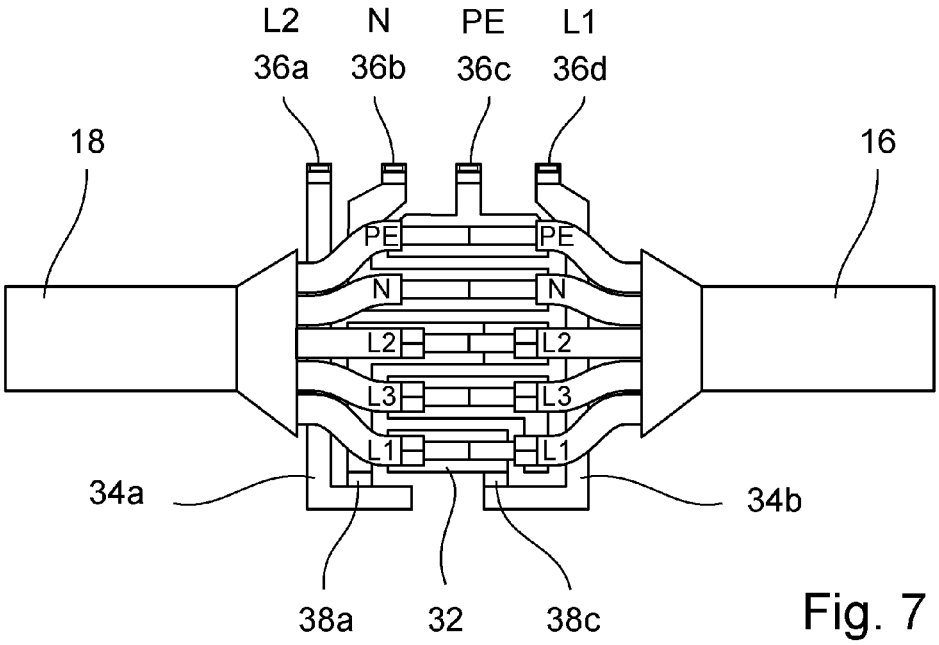
FIG. 7 a plan view of lead frame and cable with a first assignment of terminals and current bars.
Figure 8:
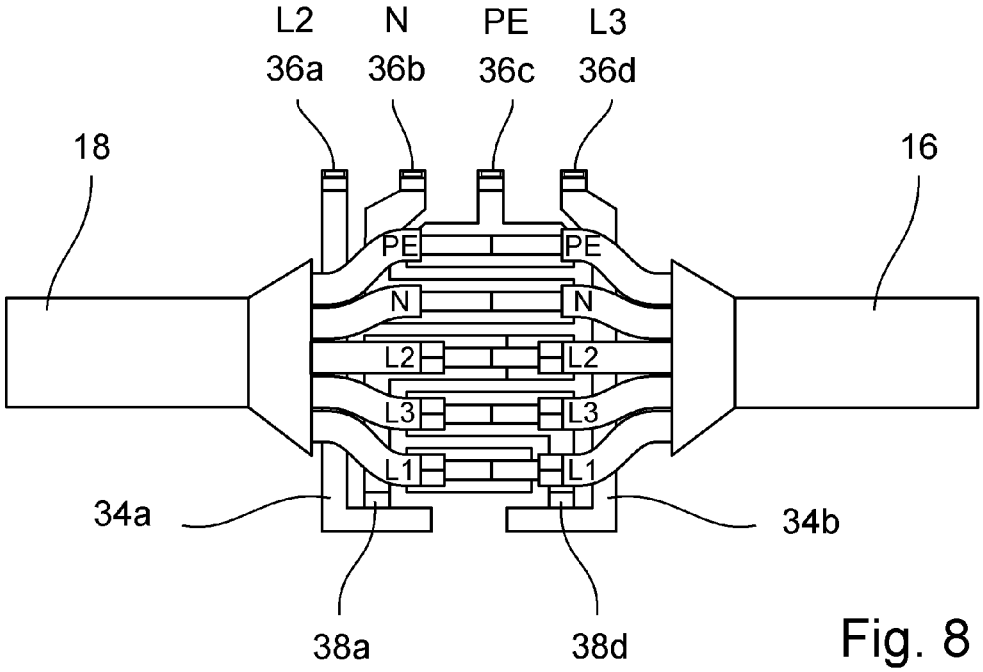
FIG. 8 a plan view of lead frame and cable with a second assignment of terminals and current bars.
Figure 9:
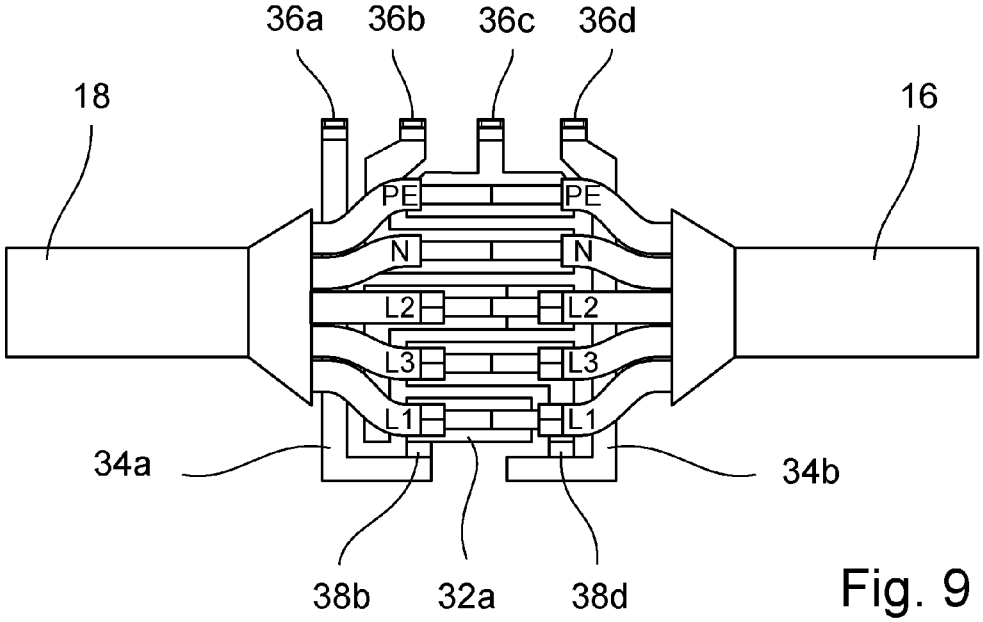
FIG. 9 a plan view of lead frame and cable with a third assignment of terminals and current bars.

In this figure and the subsequent FIGS. 7-9 it is clear that all leads L1, L2, L3, N, PE are connected in each case to terminals 32*a-e*. The connection of leads L1, L2, L3, N, PE to current bars 34*a-d* is direct for leads PE and N, because the terminals for these two leads are connected directly to the current bars 34*c* and 34*d*. Leads L1, L2 and L3 are connected by a suitable disconnection of bridges 38*a-d* to current bars 34*a* and 34*b* and from there to contacts 36*a* and 36*d*. As a result, the leads PE, N are connected in each case to the contacts 36*b*, 36*c*. This is naturally one possible embodiment example. Leads PE and N could also be connected by a suitable routing of the current bars 34*a-d* and arrangement of bridges 38*a-d*, e.g., to contacts 36*a* and 36*d*. Accordingly, leads L1 and L2 would then be connected to contacts 36*b* and 36*c*.

With bridge 38*a*, lead L2 is connected to contact 36*a*, with the interconnection of current bar 34*a*. Or, if bridge 38*a* is punched out, it is not so connected. Lead L3 is connected via bridge 38*d* and via current bar 34*b* to contact 36*d*, or is not so connected. Lead L1 is connected either via bridge 38*b* and current bar 34*a* to contact 36*a* or via bridge 38*c* and current bar 34*b* to contact 36*d*, or not, as above. As a result, lead L2 is always connected to contact 36*a*, and lead L3 is always connected to contact 36*d* when the corresponding bridges 38*a* and 38*d*, respectively, are present, whereas lead L1, assuming the corresponding presence of bridges 38*b* and 38*c*, is connected either via current bar 34*a* to contact 36*a* or via current bar 34*b* to contact 36*d*. This will be described once again in detail in reference to the subsequent figure.

In FIG. 7, leads L1 and L2 are connected via bridges 38*a* and 38*c* to terminals 36*a* and 36*d*, whereas bridges 38*b* and 38*d* are punched out. This results in a connection of lead L1 via bridge 38*c* and current bar 34*b* to contact 36*d*. When bridge 38*d* is punched out, lead L3 is not connected to any of the current bars, and therefore also is not in contact with any of contacts 36*a-d*. Lead L2 is connected via bridge 38*a* and current bar 34*a* to contact 36*a*. Including the fixed connection of leads PE and N, this therefore results in the assignment of contact 36*a* to lead L2, contact 36*b* to lead N, contact 36*c* to lead PE and contact 36*d* to lead L1.

In FIG. 8, leads L2 and L3 are connected to terminals 36*a* and 36*d*, because bridges 38*a* and 38*d* have been maintained, whereas bridges 38*b* and 38*c* have been punched out. Consequently, lead L3 is connected via bridge 38*d* and current bar 34*b* to contact 36*d*. By punching out bridges 38*b* and 38*c*, lead L1 is separated from current bars 34*a* and 34*b*. Lead L2 is connected via bridge 38*a* and current bar 34*a* to contact 36*a*. Including the fixed connection of leads PE and N, this therefore results in the assignment of contact 36*a* to lead L2, contact 36*b* to lead N, contact 36*c* to lead PE and contact 36*d* to lead L3.

In FIG. 9, leads L1 and L3 are connected via bridges 38*b* and 38*d* to terminals 36*a* and 36*d*, have been maintained, whereas bridges 38*a* and 38*c* have been punched out. Consequently, lead L1 is connected via bridge 38*d* and current bar 34*a* to contact 36*a*. Because bridge 38*a* has been punched out, lead L2 is not connected to current bar 34*a*, and therefore also is not in contact with contact 36. Lead L3 is connected via bridge 38*d* and current bar 34*b* to contact 36*d*. Including the fixed connection of leads PE and N, this therefore results in the assignment of contact 36*a* to lead L1, contact 36*b* to lead N, contact 36*c* to lead PE and contact 36*d* to lead L3.

Figure 10:
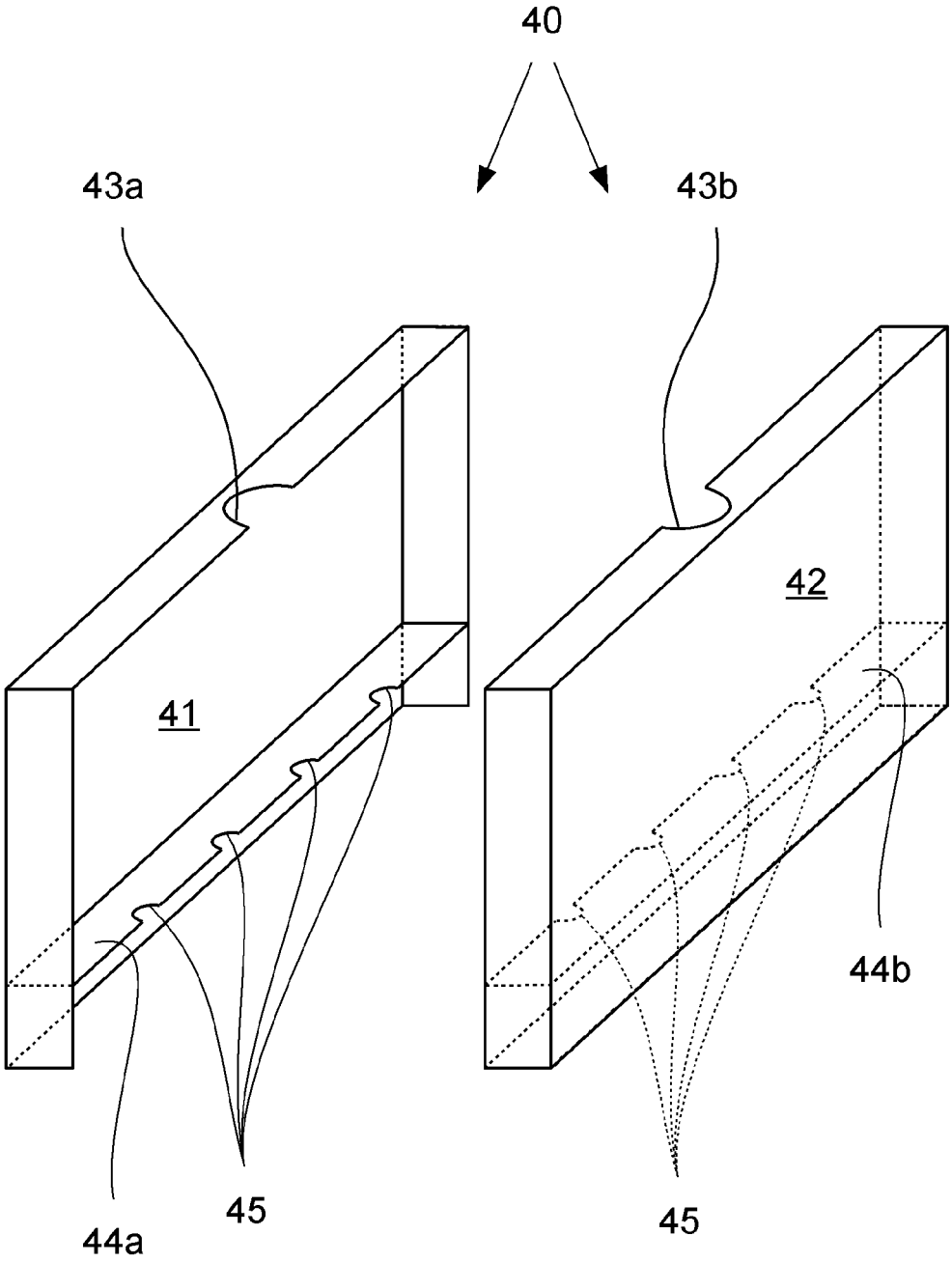
FIG. 10 a highly simplified illustration of a connector housing.

FIG. 10 shows a highly simplified illustration of a connector plug housing 40, such as can be provided for the connector plug for connection with the connecting socket (cf., FIG. 1, 2). The housing for the connector plug 40 is divided into two half shells 41, 42. In each of these half shells 41, 42, part of the cable bushing 43 is formed, so that the housing can enclose the cable (not shown in this figure).

On the inside of the housing, sealing elements 44*a*, 44*b* are integrally formed, which together seal the interior of the housing off from the contacting area, so that the housing can be potted. The openings that are required for introducing the casting compound on one side and for venting on the other side are assumed to be known and are therefore not shown in this figure.

In each of the sealing elements 44*a*, 44*b*, openings 45 are provided, through which the leads or the contacts themselves can be fed. When the housing halves 41, 42 are joined, the sealing elements 44*a*, 44*b* form a seal, which seals the interior of the housing off from the contacts, so that a casting compound, with which the housing of the connector plug 40 will be filled, cannot reach the contact area. In this manner, an air-tight housing is produced; however, sealing compound will not impair contacting reliability.

Figure 11:
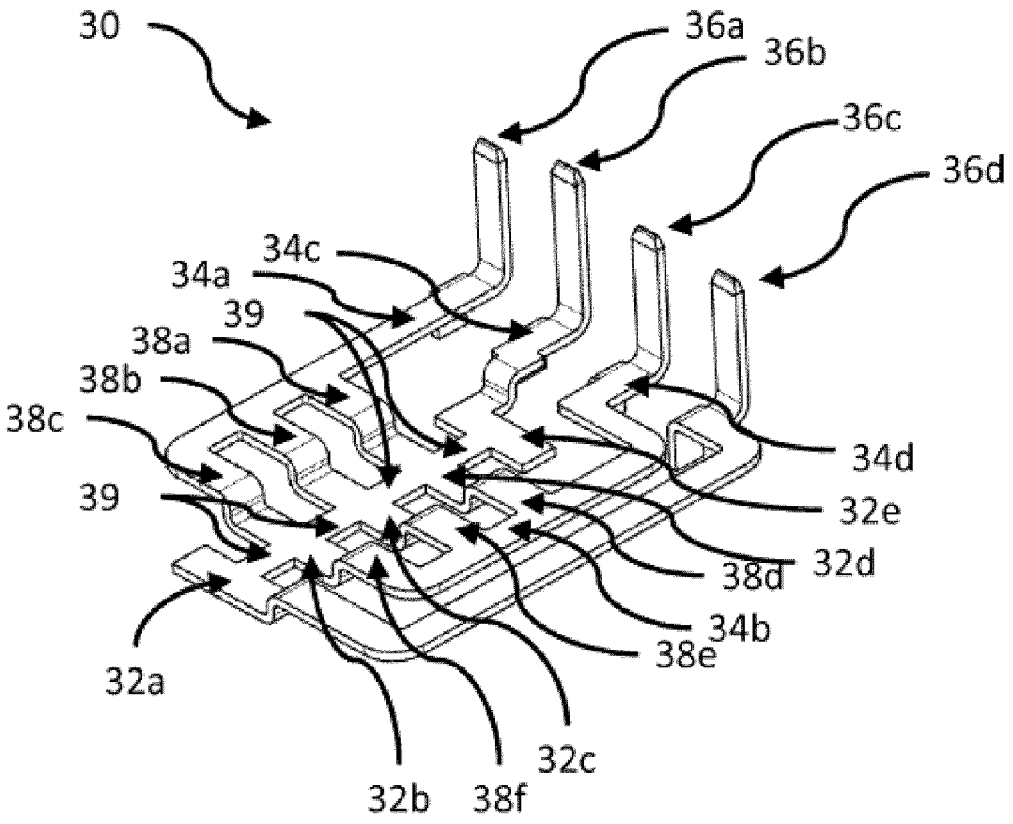
FIG. 11 a fourth embodiment of a lead frame according to the invention.

FIG. 11 shows a fourth embodiment of a lead frame 30 according to the invention. This embodiment differs from the previously discussed lead frames essentially in that the lead frame is double-bent. As a result of the double-bending, the surfaces of the terminals 32*a-e*, which are provided for the leads to be connected (not shown in this figure), jut out beyond the surfaces of the current bars 34*a-e*.

Figure 15:
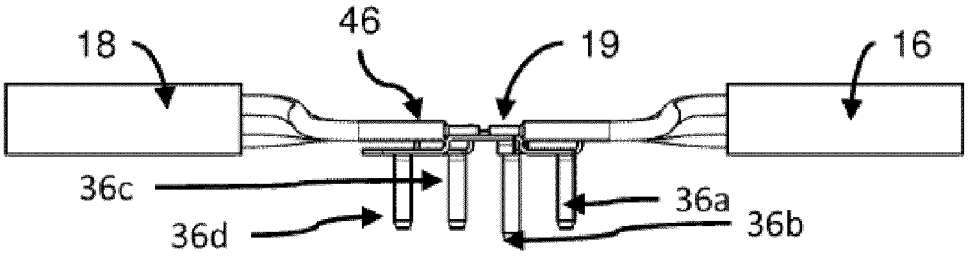
FIG. 15 a side view of a lead frame and cable according to the fourth embodiment.
Figure 16:
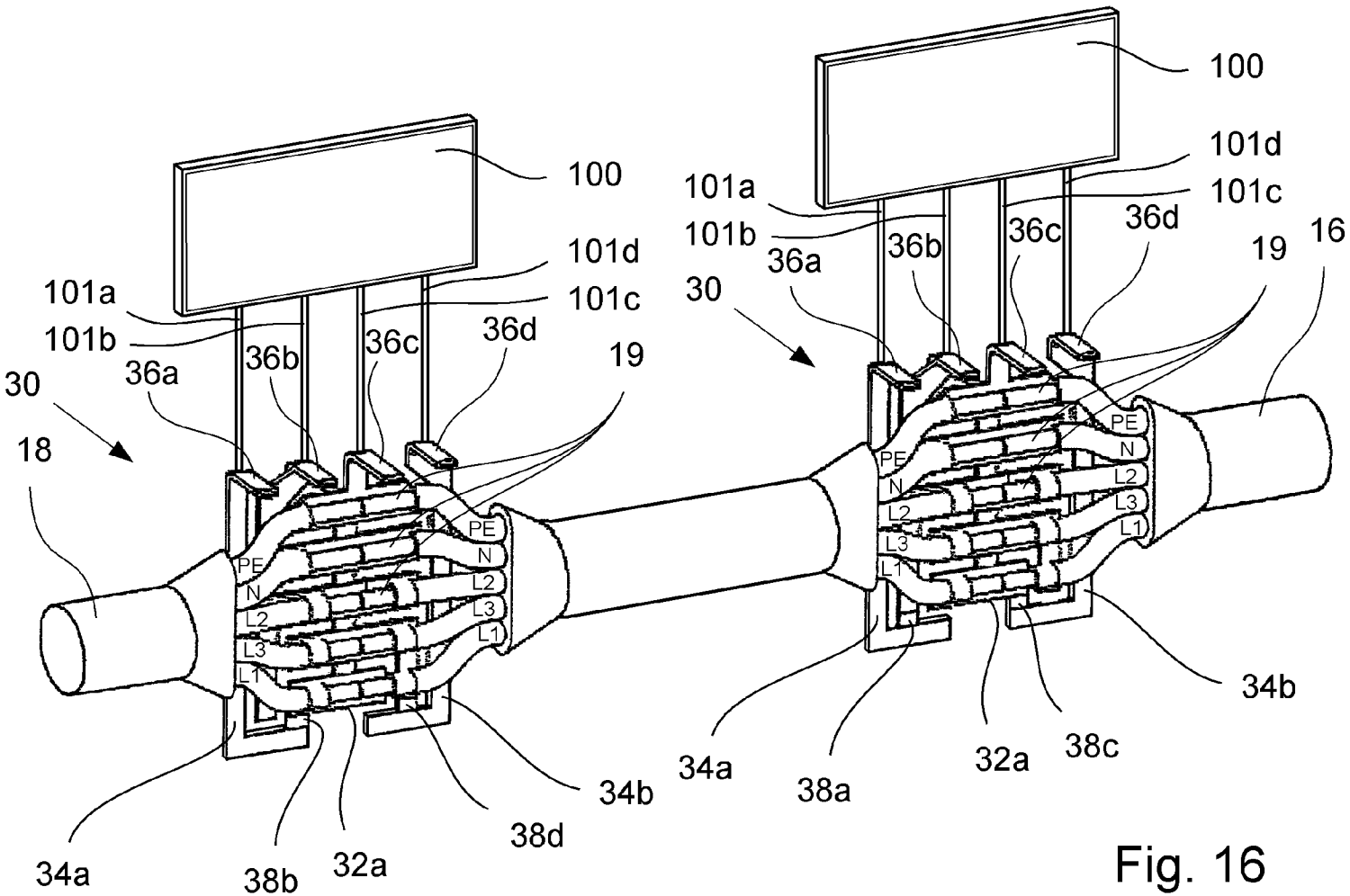
FIG. 16 a plan view of a plurality of connecting sockets with solar modules 100 connected to contacts 36*a-d* by wires 101*a-d*.
Figure 17:
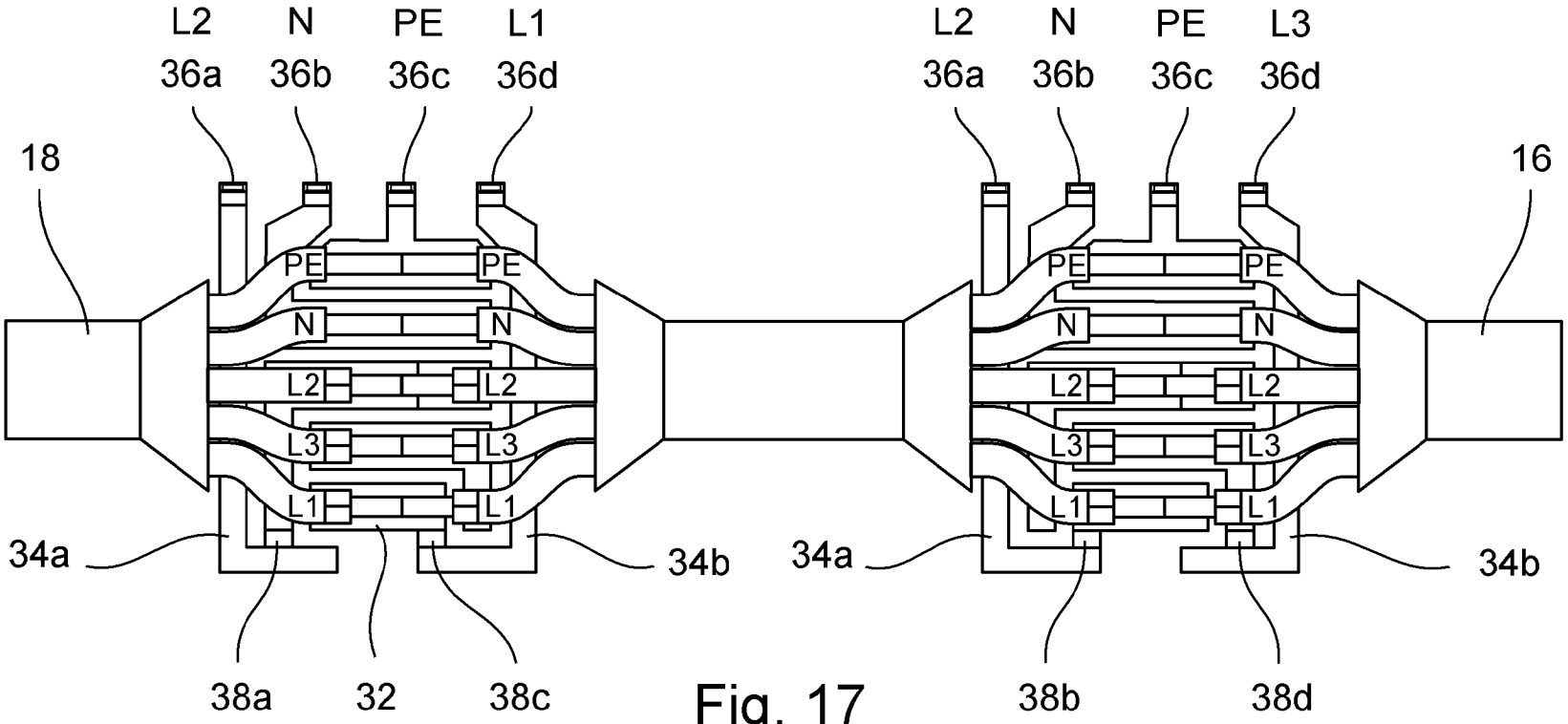
FIG. 17 a plan view of a plurality of connecting sockets with a plurality of bridges arranged according to an alternating pattern.
Figure 18:
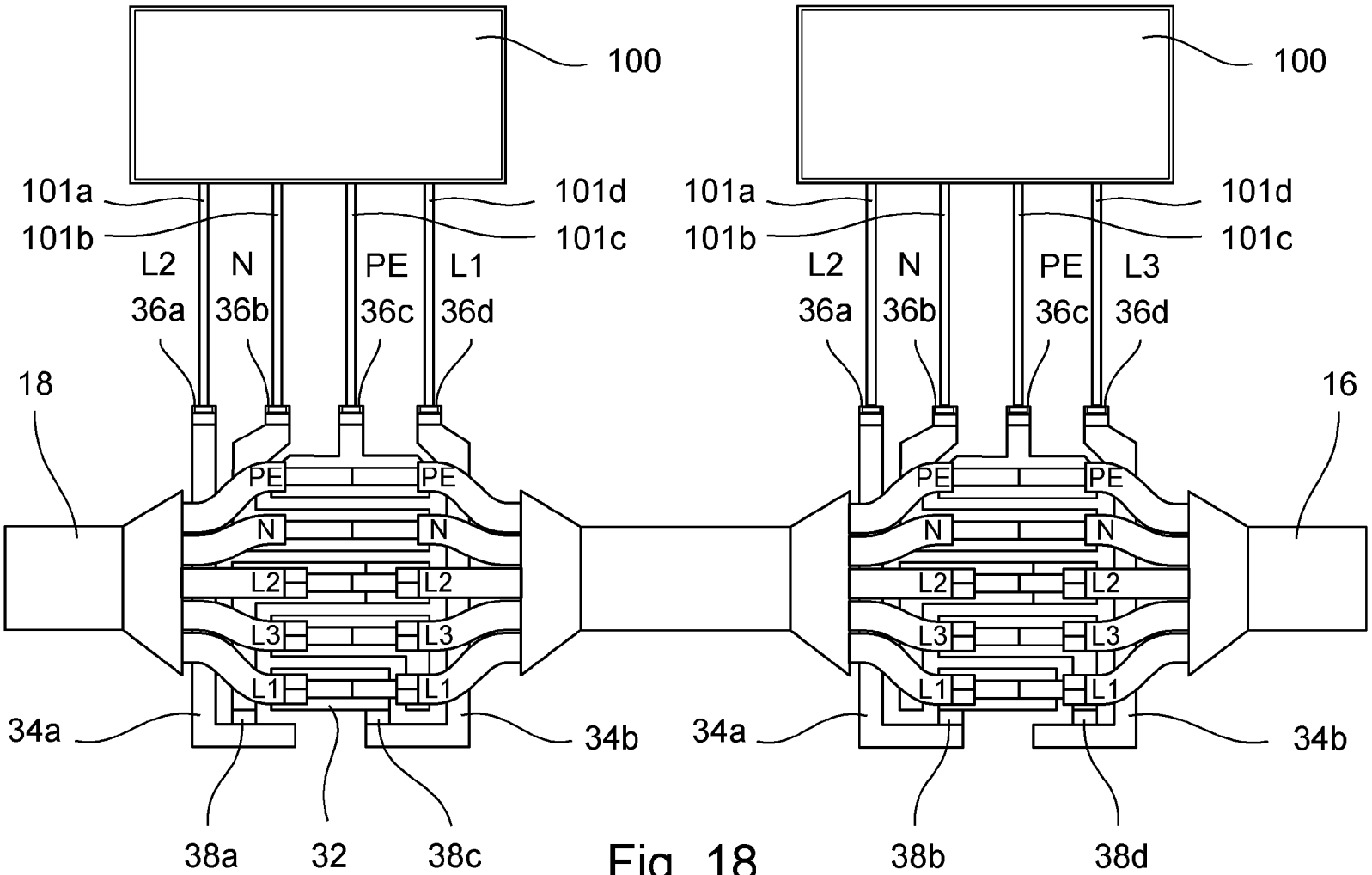
FIG. 18 a plan view of an embodiment of a plurality of connecting sockets with solar modules.

As a result of this double-bending, which is also particularly clear from the side view shown in FIG. 15, handling during the connection of the terminals 32*a-e* to the leads to be connected is particularly simple. The stripped leads 19 are attached to the respective terminals 32*a-e*, whereas cable segments 46, which are still covered with insulation, are on the opposite side of the double bend. In this manner, the insulation is prevented from exerting any force on the connection site, and additionally, even during connection, the connection site is kept free of any foreign materials that could escape from the insulating material during connection. For example, when a lead is soldered on, the insulation—if it is present at the soldering site—can become damaged by the soldering process, and as a result, decomposition products can enter the soldering site and impair said soldering site. With the invention, these effects are substantially minimized.

Figure 13:
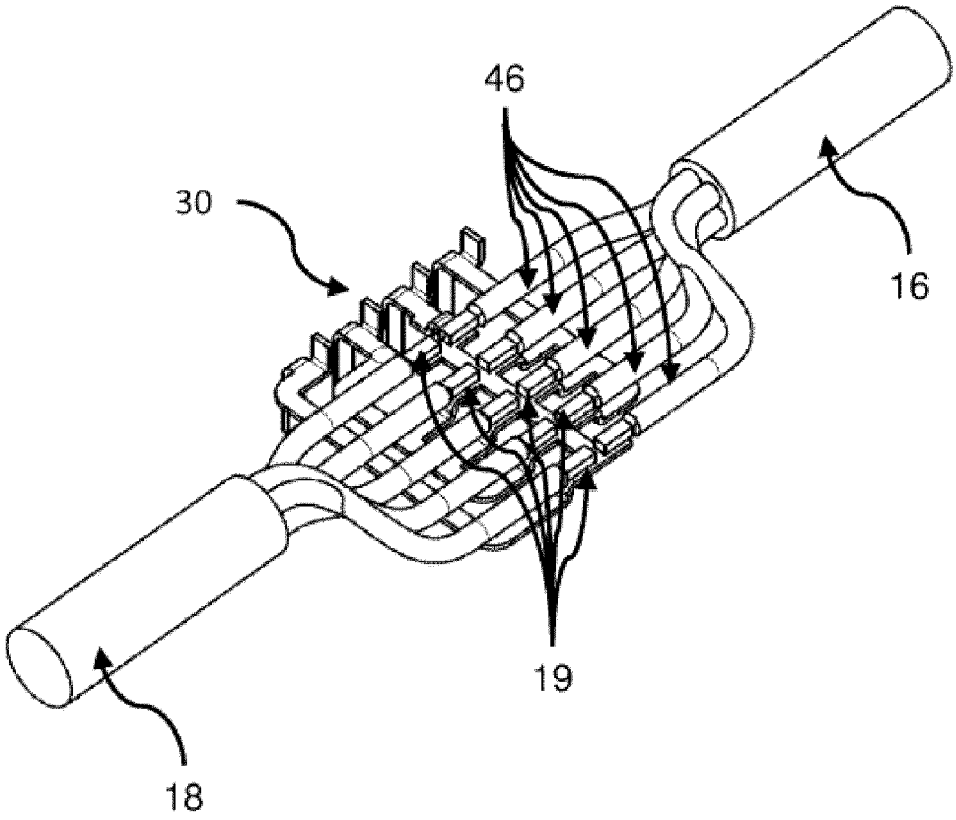
FIG. 13 a perspective illustration of the lead frame according to the fourth embodiment connected to the cable.

FIG. 13 shows a perspective illustration of the lead frame 30 according to the fourth embodiment, connected to the cable 16, 18.

In this case, the stripped leads 19 have already been attached to the lead frame 30 in a suitable configuration.

A suitable configuration of the lead frame 30 can again be produced by detaching individual bridges 38*a-f*. In this case, the bridges can also be removed after connection due to their positioning, i.e., as described above in reference to FIG. 4.

As is clear to see, the respective lead sections 46 that still have insulation are separated from the actual connection sites on the terminals 32*a-e*.

Figure 12:
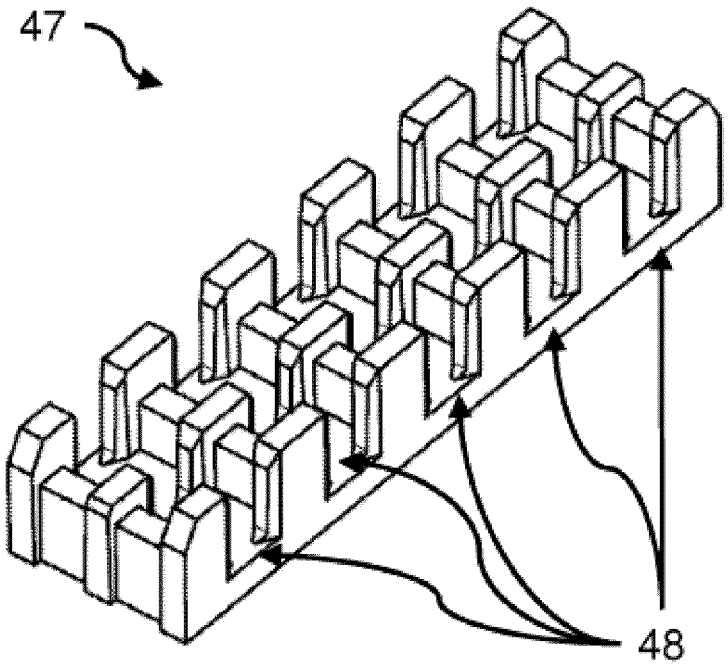
FIG. 12 a cable manager for use with various embodiments of a lead frame according to the invention.
Figure 14:
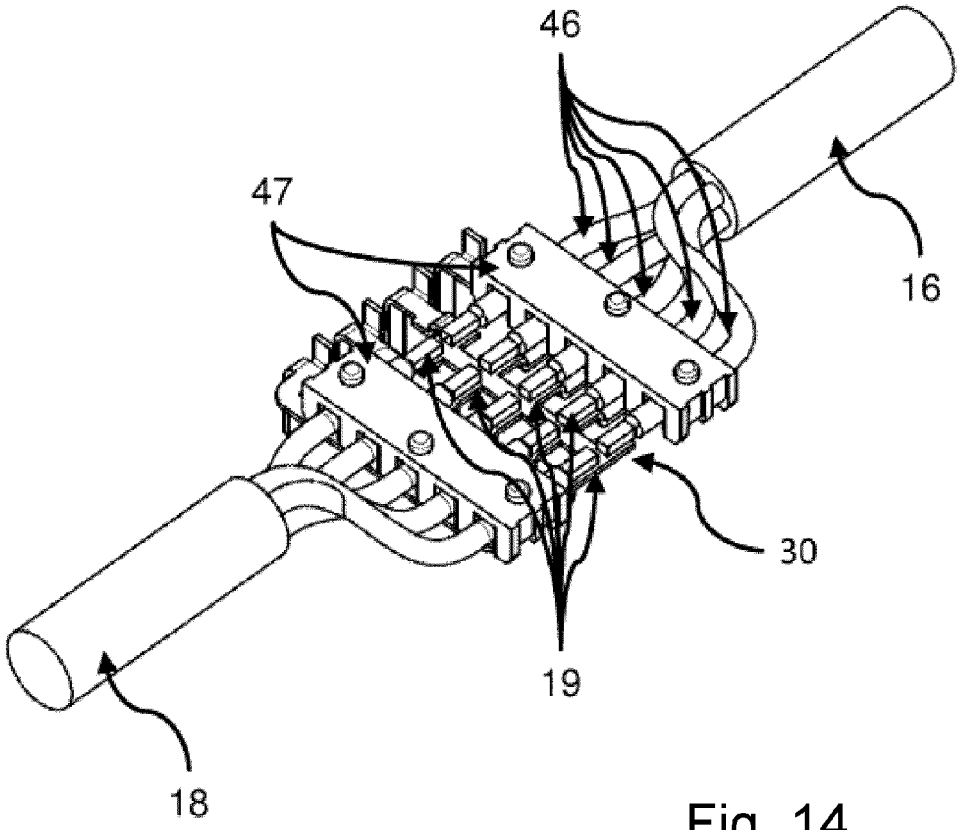
FIG. 14 a perspective illustration of the lead frame according to the fourth embodiment connected to the cable with cable managers.

FIG. 14 further shows the perspective illustration according to FIG. 13, expanded to include two cable managers 47. A cable manager 47 of this type is also illustrated in FIG. 12.

The cable manager 47 has a plurality of channel-like recesses 48, the dimensions of which are such that the recesses 48 can accommodate insulated leads 46. These recesses 48 can also have additional projections, which can enable a clamping of the insulated leads 46.

FIG. 15 further shows a side view of a lead frame 30 and cable 16, 18 according to the fourth embodiment. In this illustration, it is clear that the double bend can be embodied as larger than the insulation of a lead 47. This allows leads 47 having different thicknesses of the insulating layer to be used, without these different thicknesses of the insulating layer impeding mounting on the terminals 32*a-e*.

However, it is particularly preferable for the double bend to correspond approximately to the thickness of the insulating layer of the lead 47, because this will minimize forces on the leads 47 and/or on the connection site to the terminals 32*a-e*.

Of course, lands and supports can also be provided in the housing. Latching means on the housing, e.g., latching catches and latching tabs, for securely joining the housing half shells are also known in the prior art and are not shown in this figure.

LIST OF REFERENCE SYMBOLS

Connecting socket 10
Bottom shell 12
Top shell 14
Sealing seat 15
Cable 16
Cable opening 17
Cable 18
Stripped lead 19
Guide openings 20
Contact openings 21
Detent springs 22
Latching catches 23
Latching tabs 24
Lead frame 30
Terminal 32*a-e*
Current bar 34*a-e*
Contact 36*a-d*
Bridge 38*a-e*
Land 39
Connector plug 40
First housing half shell 41
Second housing half shell 42
Cable bushing 43
Sealing element 44
Openings for lead or contact 45
Insulated lead 46
Cable manager 47
Channel-like recesses 48

What is claimed is:

1. A lead frame for an electrical connecting socket, the lead frame comprising:
- a plurality of terminals for electrical leads;
- a plurality of contacts; and
- a plurality of current bars comprising connections between the terminals and the contacts, wherein at least two of the current bars are positioned as outer current bars, wherein each of the outer current bars comprises a first section, and wherein the first sections of the outer current bars are approximately parallel to one another,
- wherein at least one of the terminals located between the outer current bars, and
- wherein a longitudinal axis of the terminals is approximately transverse to a longitudinal axis of the first sections of the outer current bars,
- the lead frame further comprising a plurality of short residual sections of punched-out lands on adjacent end faces of the terminals for electrical leads.

2. The lead frame according to claim 1, further comprising a plurality of bridges between the first sections of the outer current bars and the terminals for electrical leads.

3. The lead frame according to claim 1, wherein a second section of each of the outer current bars is arranged at an angle relative to the first section.

4. The lead frame according to claim 1, wherein the plurality of current bars includes at least one inner current bar positioned between the two outer current bars.

5. The lead frame according to claim 1, wherein the contacts are aligned perpendicular to a plane that is spanned by the current bars and the terminals.

6. The lead frame according to claim 1, wherein the current bars have a rectilinear shape.

7. The lead frame according to claim 1, wherein the lead frame includes fewer contacts than terminals for electrical leads.

8. The lead frame according to claim 1, wherein the bridges are positioned between the terminals for electrical leads and the current bars according to a predefined pattern.

9. The lead frame according to claim 1, wherein a distance between the terminals for electrical leads is about 1.8 mm to 4 mm.

10. The lead frame according to claim 1, wherein the contacts are arranged in a row and the distance between the contacts is 4 mm to 12 mm.

11. The lead frame according to claim 1, wherein surfaces of the terminals, to which the leads are connected, jut out beyond corresponding surfaces of the current bars.

12. A system, comprising:
- a connecting socket; and
- a lead frame, comprising:
  - a plurality of terminals for electrical leads;
  - a plurality of contacts;
  - a plurality of current bars comprising connections between the terminals and the contacts, wherein at least two of the current bars are positioned as outer current bars, wherein each of the outer current bars comprises a first section, and wherein the first sections of the outer current bars are approximately parallel to one another; and
  - a plurality of short residual sections of punched-out lands on adjacent end faces of the terminals for electrical leads,
  - wherein at least one of the terminals is located between the outer current bars, and
  - wherein a longitudinal axis of the terminals is approximately transverse to a longitudinal axis of the first sections of the outer current bars.

13. The system according to claim 12, wherein a connector plug face of the connecting socket is mechanically coded by means of a plurality of contacting openings having different geometries.

14. A system according to claim 12, further comprising:
- a cable for connecting a plurality of current sources, wherein the cable comprises a plurality of leads for conducting different potentials in the cable; and
- a plurality of connecting sockets connected to the cable.

15. The system according to claim 14, further comprising a plurality of bridges arranged in the connecting sockets according to an alternating pattern.

16. The system according to claim 14 wherein the connecting sockets comprise potted connecting sockets (10).

17. A method for preparing a cable for connecting a plurality of current sources, wherein the cable comprises a plurality of leads for conducting different potentials in the cable, the method comprising:
- stripping insulation from two ends of the cable at predefined points;
- connecting the stripped ends to terminals of a lead frame, wherein the lead frame comprises a plurality of contacts, a plurality of current bars comprising connections between the terminals and contacts and a plurality of short residual sections of punched out lands on adjacent end faces of the terminals;
- placing the cable ends and the lead frame in a connecting socket;
- sealing the connecting socket; and
- potting the connecting socket.

18. The method according to claim 17, wherein connections between the terminals and multiple current bars of the lead frame are produced by detaching predetermined bridges between the terminals and the current bars of the lead frame before the stripped ends are connected to the terminals.

19. The method according to claim 17, wherein connections between the terminals and multiple current bars of the lead frame are produced by detaching predetermined bridges between the terminals and the current bars of the lead frame before the connecting socket is potted.

20. A system for transmitting electrical power, the system comprising:

a plurality of connecting sockets, wherein each of the connecting sockets has a lead frame, comprising:

a plurality of terminals for electrical leads;

a plurality of contacts;

a plurality of current bars comprising connections between the terminals and the contacts, wherein at least two of the current bars are positioned as outer current bars, wherein each of the outer current bars comprises a first section, and wherein the first sections of the outer current bars are approximately parallel to one another; and a plurality of short residual sections of punched-out lands on adjacent end faces of the terminals for electrical leads, wherein at least one of the terminals is located between the outer current bars, and wherein a longitudinal axis of the terminals is approximately transverse to a longitudinal axis of the first sections of the outer current bars; and at least one cable for connecting a plurality of current sources, wherein the at least one cable comprises a plurality of leads for conducting different potentials in the cable.

* * * * *